United States Patent [19]

Yach

[11] Patent Number: 4,473,197

[45] Date of Patent: Sep. 25, 1984

[54] INDUSTRIAL CABLE REEL APPARATUS HAVING SPRING-LOADED REWIND MOTOR

[75] Inventor: Robert L. Yach, West Bend, Wis.

[73] Assignee: McGraw-Edison, Rolling Meadows, Ill.

[21] Appl. No.: 265,113

[22] Filed: May 18, 1981

[51] Int. Cl.[3] ..... B65H 75/48

[52] U.S. Cl. ..... 242/107.6; 191/12.2 R; 242/107.5

[58] Field of Search ..... 242/107.5, 107.6, 107.4 R, 242/107; 191/12.2 R, 12.4

[56] References Cited

U.S. PATENT DOCUMENTS

| | | | |
|---|---|---|---|
| 2,333,559 | 11/1943 | Grady et al. | 242/107.6 |
| 2,592,143 | 4/1952 | Holtz et al. | 242/107.5 |
| 3,033,488 | 5/1962 | Weber | 242/107.5 |
| 3,151,823 | 10/1964 | Clarke | 242/107.5 |
| 3,326,493 | 6/1967 | Bondesen, Jr. | 242/107.6 |
| 3,593,941 | 7/1971 | Smith | 242/107.5 X |
| 3,694,588 | 9/1972 | Appleton | 242/107.5 X |

*Primary Examiner*—John M. Jillions

*Attorney, Agent, or Firm*—Eugene R. Sawall; Jon Carl Gealow; Hugh M. Gilroy

[57] ABSTRACT

A cable reel apparatus includes a rotatably mounted cable spool in a fixed support. A locking pin is provided on the support and is engageable with the spool to hold the spool and cable hook-up in a fixed position. A gear unit connected to the support includes a spool gear rotatably mounted on a spool shaft and a spring gear coupled to a spring motor. Friction drive discs are located to the opposite sides of the spol gear and coupling discs abut the drive discs. The coupling discs are connected to the spool shaft. "Belleville" disc springs are mounted in abutting engagement with the outer coupling discs and the nut is threaded on the shaft to collapse the springs onto the coupling discs to increase the spring force and lock the gear to the shaft. The nut may be released to reduce the spring force and effectively decouple the shaft and gear, thereby permitting controlled release of the tension in the spring drive means.

7 Claims, 6 Drawing Figures

INDUSTRIAL CABLE REEL APPARATUS HAVING SPRING-LOADED REWIND MOTOR

BACKGROUND OF THE INVENTION

This invention relates to an industrial cable reel apparatus for the storage and support of flexible cables upon a rotatable cable support having a spring-loaded rewind motor means coupled to the support.

Many electrical as well as fluid power systems require relatively long cables for transmission of power between a power supply and a remote load device. The various applications may require relatively long vertical extensions or horizontal extensions of the cable. Elongated cables which are not confined are subject to damage or destruction in most industrial applications and the like.

A steel mill installation is a typical installation wherein relatively long vertical and/or horizontal cable extensions are required. Vertical lifting apparatus may, for example, require application of power to a lifting head. In such a vertical lift a cable is extended and moved vertically with the lifting device. In other applications, an overhead crane-like unit may be mounted on trolley unit. Power may be supplied to the trolley unit using an elongated flexible cable of sufficient length to extend between a power supply connection and the remotest location of the trolley unit. In other applications encountered in a steel mill, various extension and retrieval requirements are created which require corresponding movement of a power cable or the like.

Similar cable specifications are encountered in other industrial applications.

Cable reel apparatus is available to contain and store a flexible cable while permitting the extension and retrieval thereof as the distance between the supply device and the connected device changes. As employed herein, the terminology "cable" will generically identify elongated flexible elements, including electrical cables, pneumatic and hydraulic hoses and other like flexible elements which can be conveniently wound and unwound on a cable reel support and particularly a cable spool.

Although each particular installation requires selection of a particular design, the cable reel apparatus is basically of a similar construction and generally includes a rotatably mounted spool unit defining a cable support means on which the cable is wound and unwound. The spool is rotatably mounted in an appropriate mounting or support structure, which may be a mobile unit or a fixed support structure. A power connector unit is connected to the support and located to the one side of the spool normally on a common axis. A rotary power coupling unit is mounted within the collector unit and includes a power connecting means which extends through the assembly to a connection to the inner end of the cable, thereby permitting rotation of the spool and cable relative to the collector and the fixed supply. For example, in an electrical system a brush and ring contact assembly will provide for convenient electrical power connection. The cable reel apparatus further includes a return means which may be an electric motor or a spring motor unit. The spring motor unit, generally is in the form of a spiral clock spring, secured to the opposite side of the support from the collector and coupled through a suitable lubricated gear coupling means to the spool. The spiral spring unit is constructed and arranged such that the spiral springs are stressed with the spring forces arranged to rotate the spool to wind the cable onto the spool. The force is such however, that the cable can be unwound from the spool by pulling thereon, with the spool rotating and tensioning the spiral spring unit. When the load on the cable is released, the spring unit serves to provide a controlled rewind of the cable onto the spool.

Although cable reel apparatus is available in compact, rugged and reliable structures for use in industrial environments, such as in a steel mill and the like, the mechanical construction inherently may require periodic maintenance and service and the like. In some cases, a cable reel apparatus may require adaptation to a different load requirement. In industrial environments, substantial spring forces must be available and created by the spiral spring units. For example, in a steel mill, electrical 600 volt cables may have to extend for hundreds of feet in any given application. A plurality of paralleled spring or series units may be connected to the cable reel to create the desired driving force for moving of the cable. To service or modify the unit therefore generally requires complete disconnection of the cable hook-up in order to permit release of the tension on the spring mechanism. The required disconnection may be costly and time consuming, as well as inconvenient.

There is therefore a need for a safe but reliable means for releasing of the spring tension while maintaining of the cable system hook-up in place.

SUMMARY OF THE INVENTION

The present invention is directed to an industrial type cable reel apparatus having a tension spring drive means for moving the relatively high load forces, and specially constructed with a detension means permitting removal of the load on the spring drive means without disconnection of the cable hook-up system. Generally in accordance with the teaching of the present invention, the cable reel apparatus includes a cable support rotatably mounted in a support means, and having a spring drive means coupled to the cable support means for establishing and maintaining a rewind force on the cable. A gear coupling means connects the spring drive means to the cable support means and includes a releasable detension means for controlled and essentially controlled release of the connection between the spring means and the cable support means. A releasable holding or locking means is also provided for holding of the cable support means in a given position, thereby providing for a holding of the cable hookup in any given position. The releasable detension means can be actuated to provide a controlled release of the stored energy of the spring means with the cable support means held in a fixed position. This permits the detensioning of the spring drive means without the necessity of disconnection of the cable hook-up system. The cable reel apparatus and particularly the gear coupling and the spring drive means can then be serviced, replaced or the like without disturbing the cable hook-up system. The releasable coupling means may advantageously be a friction coupling means having a friction coupling element and a coupled element with means coupled to move the elements into and out of engagement.

In a particularly unique and practical embodiment of the present invention, the cable reel apparatus includes a conventional cable spool rotatably mounted within a suitable support. A gear box unit is connected to the support and includes a spool gear rotatably mounted on a shaft which is coupled to drive the cable spool and a spring gear adapted to be coupled to a spiral spring drive. Friction drive elements are located to the opposite sides of the spool gear and are adapted to be clamped in driving engagement with the spool gear. A suitable spring means, which includes preferably one or more "Belleville" springs, is also mounted in operative engagement with the friction elements to transmit the torque between the shaft and gear. A releasable clamp means is coupled to the spring means and is operable to increase the spring force and thereby effectively lock the gear to the shaft for transmitting of the gear force to and from the cable shaft. The clamp means may also be released to correspondingly reduce the spring force and the effective locking of the shaft and gear, thereby permitting a controlled release of the tension in the spring drive means.

In normal operation, the clamping unit is tightened to establish an essentially fixed operative connection between the shaft and the output gear. The result is direct transmission forces between the cable spool and the spring drive means to provide the normal winding and release of the cable on the spool. If necessary to service the unit for any reason, the cable spool is locked in place. The clamping means is then gradually released to correspondingly reduce the clamping pressure exerted by the "Belleville" or other coupling springs. As the clamping pressure is reduced, the spool gear may rotate relative to the spool shaft, thereby providing for a corresponding release of the stored energy within the drive springs. This permits full and complete detensioning of the spring drive means without the necessity of disconnecting or otherwise disturbing the cable hook-up.

The particular drive coupling spring load may of course vary with the particular application. A convenient means of providing the appropriate spring force is the connection of a plurality of spring drives to a common shaft. The detensioning and coupling spring means must of course be selected to maintain the desired force transmission under normal operation for the various drive spring systems. In a preferred embodiment, the inventors have found that the coupling force can be closely correlated to the drive spring force by use of a basic "Belleville" spring unit for a single spring drive means, and then for adding-on an additional "Belleville" unit for each additional drive unit.

The inventors have found that the components and system provides a relatively simple detensioning apparatus which can use commercially available components suitable for an industrial environment while maintaining the necessary reliability and safety in functioning. The present invention in a preferred embodiment is particularly adapted to commercial implementation without significant redesign of the cable reel apparatus.

DESCRIPTION OF THE DRAWING FIGURES

The drawings furnished herewith illustrate a preferred construction of the present invention in which the above advantages and features are clearly disclosed as well as others which will be readily understood from the following description.

DESCRIPTION OF THE ILLUSTRATED EMBODIMENT

Figures 1, 2:
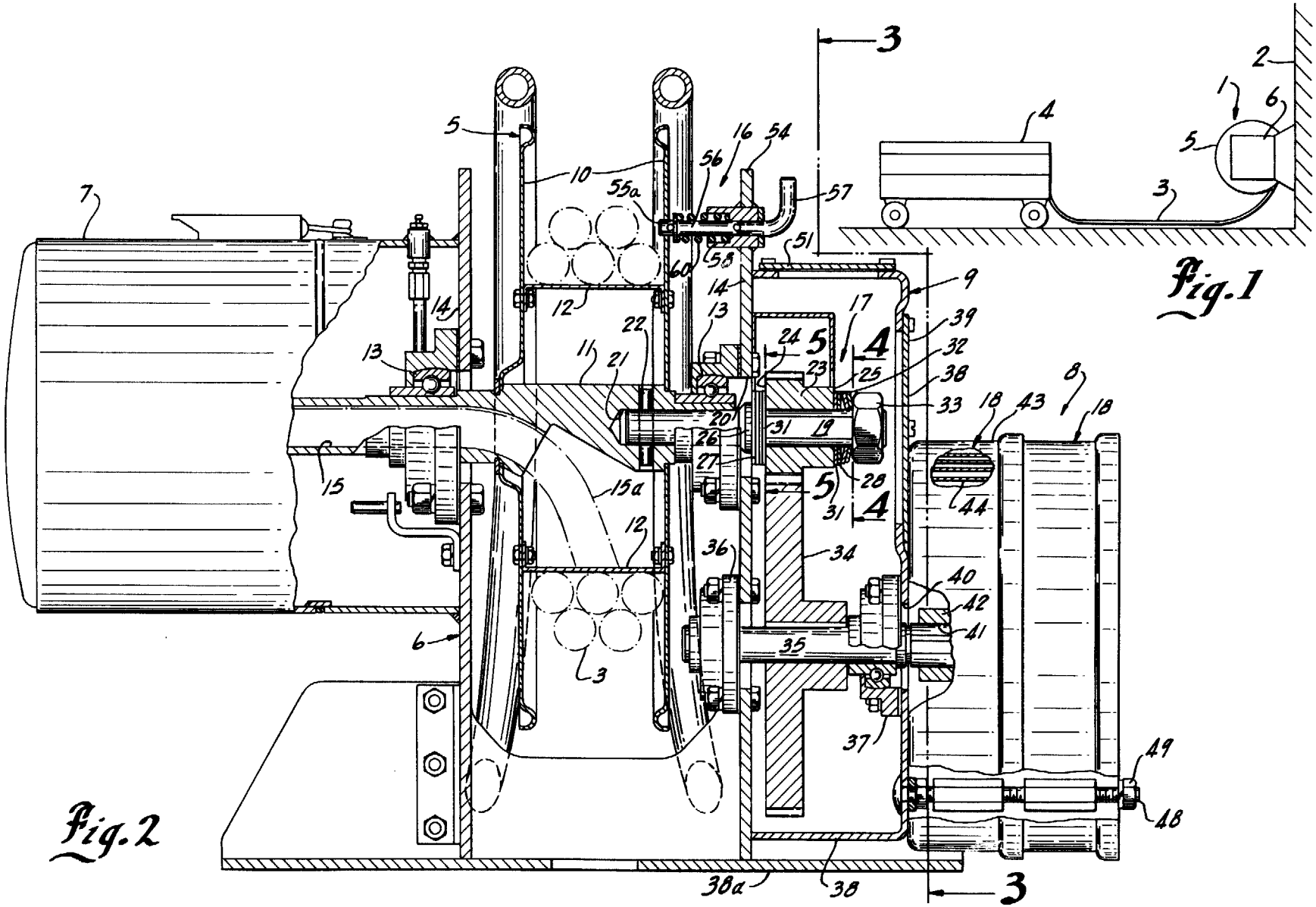
FIG. 1 is a pictorial view of a horizontal retriveal apparatus illustrating an application of the present invention.
FIG. 2 is an enlarged vertical section through a cable reel apparatus incorporating a preferred embodiment of the present invention.

Referring to the drawings and particularly to FIG. 1, an industrial cable reel apparatus 1 is shown mounted to a fixed supporting unit 2. Cable reel apparatus 1 supports a power cable 3 adapted to be extended outwardly therefrom and secured to a mobile support unit 4. The cable reel apparatus 1 includes a cable spool 5 which is rotatably mounted in a mounting support or base unit 6 for attachment to supporting unit 2. A power collector unit 7 is secured to the mounting support 6 to one side of the cable spool 5. A spring drive unit 8 is located and secured to the support unit 6 to the opposite side of the cable spool 5 and is coupled through a gear unit 9 to drive the spool 5 to rewind the cable 3 thereon. The illustrated spool is of a known construction and includes a pair of laterally spaced spool walls 10 which are secured to a support shaft 11. The spool 5 includes an annular base wall 12 secured between the side walls 10 and outwardly of the shaft 11. The cable 3 is wound on the base wall 12 and between the outer portions of the spool walls 10, as most clearly shown in FIG. 2. The shaft 11 extends outwardly to the opposite sides of the spool walls 10. The opposite ends of the shaft 11 are rotatably journaled in suitable bearings 13 secured to a pair of correspondingly appropriately spaced support plates 14 forming an integrated part of the mounting unit 6. The spool is thus mounted for relatively free rotation within the support unit 6.

The collector unit 7, as most clearly shown in FIG. 2, is mounted to the one side of the spool 5. The collector unit 7 is constructed to provide a rotary power connection to the cable 3 and as such devices are well known, the detail of the collector unit 7 is not shown or described. Generally, the spool shaft 11, which extends into collector unit 7, includes an axial opening 15 extending from the collector and into the spool 5, where it terminates in a lateral extension into the spool. A connection line 15*a* from a rotating power connection extends through the opening 15 and the internal chamber defined by the spool base for connection of the innermost turn of cable 3 to a power connection. Cable 3 generally is extended as line 15*a*, or a seperate line 15*a* may be connected to the innermost turn of cable 3.

As the detailed and particular construction of the spool 5 and the collector 7, the respective mounting thereof may be of any desired construction and can be readily provided by those skilled in the art, no further description of such components is set forth herein other than as necessary to a full and complete description and understanding of the present invention, which is particularly directed to a modification and construction of the coupling of the spring drive unit 8 and the gear unit 9 with a special spring detensioning means 17 in the gear unit 9.

A mechanical locking mechanism 16 is mounted on support plate 14 and is operable to engage and hold spool 5 in place during operation of the detensioning means 17, as hereinafter described.

The illustrated spring drive unit 8 includes a plurality of similar spring drive motors 18 secured to the outer face of the gear unit 9 and connected by the gear coupling unit 9 to the spool 5 and particularly to the spool shaft 11. The detensioning means 17 is located between the spool shaft 11 and the output of the gear coupling unit 9 to permit release from the shaft 11, such that the spool can be fixed while permitting independent movement of the gear coupling unit 9 and the spring drive motors 18.

In the illustrated embodiment of the invention, the gear unit 9 includes a spool shaft 19 extending through an opening 20 in the support plate 14 into coupling connection to the spool shaft 11, in any suitable manner, to form an extension of the shaft 11 into the gear unit 9. The illustrated spool shaft 11 is formed with an axial opening 21. The spool shaft 19 extends into the opening and is affixed thereto as by a suitable connecting pin 22.

Figure 5:
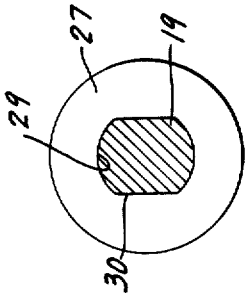
FIG. 5 is a view taken generally on line 5—5 of FIG. 2 to more clearly illustrate a coupling disc of the releasable coupling.
Figure 4:
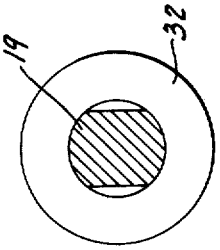
FIG. 4 is an enlarged fragmentary transverse view taken generally on line 4—4 of FIG. 2 to more clearly illustrate a friction disc of a releasable coupling in the preferred embodiment of the present invention.

A spool gear 23 is rotatably mounted on the shaft 19. The gear 23 is shown as a hubbed gear member and is specially formed with flat end faces or surfaces 24 and 25. The shaft 19 is also provided with an annular enlargement 26 defining a stop wall inwardly of the gear 19. A releasable coupling includes a plurality of force transmitting washers 27 interposed between the enlargement 26 and the adjacent flat gear surface 24. A similar force transmitting washer 28 is located on the shaft 19 to the opposite side of the coupling spool gear 23. Each of the force transmitting washers is similarly constructed and non-rotatably affixed to shaft 19 to directly transmit forces to and from such shaft. In the illustrated embodiment of the invention, each of the force transmitting washers 27 and 28 is similarly formed with a double "D" opening or hole 29, as shown in FIG. 5. The hole 29 corresponds to and complements a corresponding cross-sectional configuration of shaft 19 outwardly of the enlargement 26, which, as most clearly shown in FIG. 5 is formed with opposed flats 30. The rotation of the shaft 19 forces a corresponding rotation of the force transmitting washers 27 and 28. Similarly, a forced rotation of the washers 27–28 will result in a corresponding rotation of the shaft 19. Friction discs 31 are located on the shaft 19 immediately to the opposite sides 24 and 25 of the gear 23 and thus are directly interposed between the gear and the respective force transmitting washers 27 and 28. A spring means, shown as spring washers 32, is located on the outer end of the shaft 19 and acts on the corresponding force transmitting washer 28 to clamp the assembly including the transmitting washers 27–28 and the friction discs 31 and the gear in a stacked relation abutting the stop 26. In the illustrated embodiment of the invention, washers 32 are shown as known "Belleville" spring washers. Thus, each washer 32 is a similar dished member having a shaft opening and located on the shaft 19 abutting the outermost force transmitting washer 28. A clamping means shown as a hex nut 33 is threaded onto the correspondingly threaded outer end of the shaft 19. The threading of the nut 33 onto the shaft 19 of course collapses the "Belleville" spring washers 32 and establishes a high axial force on the interengaging end face 24 and 25 with the friction discs 31. With nut 33 drawn up tightly, the friction discs 31 establish a firm drive engagement with the corresponding opposed end surfaces 24 and 25 of the gear 23.

During normal operation, the hex nut 33 will be threaded tightly onto the shaft 19 to sufficiently compress and distort the spring washers 32 to establish such an effective operative fixed connection of the gear 23 and the shaft 19 through the friction coupling. In the normal operation, there will be no relative movement between the gear 23 and the gear shaft 19 and the rotating forces will be transmitted between the spool 5 and the gear unit 9 as if the gear train was a fixed or rigidly connected gear system. If the spool 5 is held fixed by the locking mechanism 16, the hex nut 33 can be released to effectively open the operative connection of the spool to the gear system and thereby to the spring units for detensioning of the spring unit 8 with the cable hook-up locked in place, as presently described.

In the illustrated embodiment of the invention, the gear unit 9 includes the gear 23 and a second gear 34 mounted on a shaft 35. Gear 34 is substantially larger than gear 23 to provide a corresponding speed change between shafts 19 and 35. A bearing 36 secured to the outer support plate 14 supports the one end of the shaft 35. A bearing 37 supports the opposite end of shaft 35 on the wall of an outer box-like enclosure 38 of the gear unit 9. The box-like enclosure 38 is formed of a suitable metal and is mounted within a generally U-shaped support bracket **38*a* which is secured to the mounting base unit 6. The enclosure 38 includes a covered end opening 39 aligned with the detensioning means 17 and an opening 40 aligned with the spring unit 8 for coupling of the shaft 35 to the spring unit 8. The outer end of the shaft 35 which projects from the housing is formed with a bayonet coupling end 41. A spring drive shaft 42 is formed with a complementing end which is adapted to receive and thereby couple the shaft 35 to the spring motor 18 as a result of mounting the spring unit 18 in operative relation to the gear unit 9**.

The coil spring motors 18 are correspondingly constructed devices which are adapted to be mounted in cascade for increasing of the driving force applied to the gear unit 9 and thereby to the spool 5.

More particularly, the illustrated spring drive motor 18 includes an outer cylindrical housing 43. A spiral drive spring 44 is coiled within the housing 43. The illustrated drive spring 44 is a well known typical spiral clock spring of a flat spring stock having a substantial number of spiral turns. One end of the coil spring 44 is secured to the outer peripheral wall of housing 43 while the inner end thereof is secured to the spring drive shaft 42. The spring motor 18 may be provided with any suitable pretensioning means, not shown, for establishing a suitable spring force with the cable 3 wound on the spool 5.

The spring drive shaft 42 has the outer end mating with the gear shaft 35 to provide a direct mechanical coupling of the shafts. Thus, with the coil spring 44 tightened, a continuous spring load is applied through the shafts 42–35 to the gear unit 9 and thereby to the spool 5. The coil spring 44 is wound such that a continuous load is applied to the spool unit in a direction to wind the cable 3 onto the spool 5.

The second spring motor 18 is constructed identical to that of first spring motor 18 and may be mounted on the outer wall thereof, with its shaft, not shown, coupled to the shaft of the first spring motor 18.

As shown most clearly in FIG. 2, the motors 18 are mounted in abutting relation to each other with the innermost spring drive motor 18 abutting the gear enclosure and with the second abutting the end face of the first. The drive motors 18 are secured to the gear unit 9 by clamping bolts 48 which extend through the spring housing 43. Clamping nuts 49 are secured to the outer end of the clamping bolts 48 to securely clamp the spring motors 18 to the enclosure with the interconnected shaft connections. Each of the clamping bolts is shown as a multiple part and modular construction to permit forming of different lengths to accommodate different numbers of spring motors 18. For example, for use in a steel mill the load requirements may be such as to require up to four spring motors 18.

Figure 3:
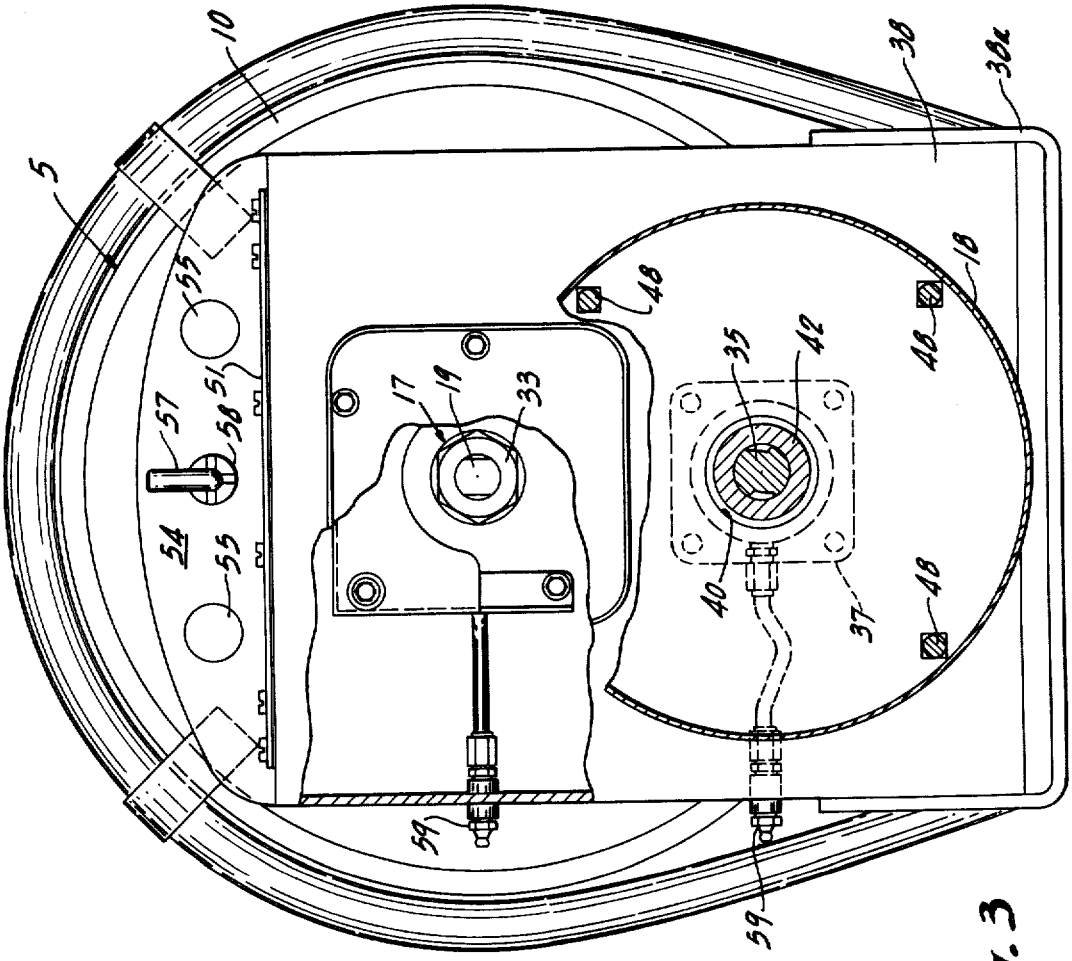
FIG. 3 is an elevational view of the gear unit shown in FIGS. 1 and 2 and taken generally on line 3—3 of FIG. 2.

As shown most clearly in FIG. 3, the gear enclosure 38 includes a top wall opening having a releasably attached cover 51 which also permits access to the detensioning nut 33 as well as to the gear unit for servicing and the like.

Suitable grease fittings and 59 are provided extending inwardly from the side wall of the housing to permit introduction of lubrication into the gearing and bearings without the necessity of dissassembly of the enclosure.

The upper end of the support plate 14 is shown extending upwardly to define a lifting plate portion 54 having suitable lifting openings 55. In addition, the spool locking mechanism 16 is secured to the support plate 14 and is operable to hold the spool 5 and the cable hook-up in place. In the illustrated embodiment, the locking mechanism 16 includes an L-shaped pin 56 having a locking handle 57 which projects through a hub 58 in the plate 14. The pin 56 may be selectively positioned to introduce the pin 56 into locking openings **55*a* provided in the adjacent spool wall 10 of the spool 5. Sets of locking openings 55*a* are provided in the wall 10 to permit locking of the hook-up in practically any desired position. The four sets of openings may conveniently be spaced 90° about the spool. A spring 60 encircles the inner end of the pin and resiliently urges the pin 56 inwardly into a locking position. The L-shaped pin 56 defines an outer handle 57 for manually positioning the pin 56 between a locking position and a spool release position. The operator pulls outwardly on the handle 57 to release the pin 56 and turn the pin to place the handle 57 in a release position on the hub 58. The hub 58 may be provided with edge recesses to positively locate the angular position of the handle 57**. The alternate positioning positively holds the pin from the locking position.

In summary, in the illustrated embodiment of the invention, the locking pin 56 is held in the release position during normal operation. The spool 5 is continuously loaded by the spring unit 8 with the torque load determined by the force of the spring unit 8 and the leverage created by the gear unit 9. Under this state, the cable 3 can be withdrawn from the spool 5, with a continuous loading of the spring unit 8. Removing or reducing the load on the cable 3 allows the spring unit 8 to automatically rewind the cable on the spool 5.

If, for any reason, either the gear unit 9 or the spring unit 8 must be serviced or modified, the operator releases the locking mechanism by placing the pin 56 in the closest adjacent locking wall opening 59 of the spool 5. This of course positively holds the cable hook-up in the last position. The covered access opening 51 permits convenient access to the hex nut 33 of the detensioning means 17. The nut 33 is turned to slowly reduce and release the pressure of the collapsed "Belleville" spring 32. This permits slipping motion on the face of the friction elements 31 and thereby relative movement between the shaft 19 and the gear 23. The degree of movement is controlled by the degree of pressure release on the friction elements by the hex nut 33. Thus, the operator can slowly release the hex nut 33 and provide a corresponding release of the spring tension. As the coupling spring 32 is released, the force of drive spring 44 will cause the gears 34, 23 to rotate, with the small gear 23 rotating with a slipping force with respect to the friction elements within the friction coupling and therefore the shaft 19. The drive springs 44 thus uncoils and by suitable loosening of the nut 33 continues to uncoil until the full tension has been released.

Thereafter, the sevice personnel may safely and directly attend to the necessary maintenance, such as by removing of the coil spring devices 18 from the enclosure 38, and if necessary servicing the gear unit 9.

The friction coupling within the gear unit 9 has been found to provide a reliable, rugged connection for maintaining normal operation while simultaneously providing a relatively simple means for servicing field installations with the cable hook-up in place. After the necessary work has been done, the coupling 17 is reset by tightening of the nut 33, gear unit 9 is again closed and the spring unit 8 appropriately attached in operative engagement with the gear unit 9. The spring unit 8 is pretensioned to again create the desired loading on the spool 5. Thereafter, the spool locking mechanism 16 is released and the system returns to normal operation.

For example, in practice the illustrated system may include up to four spring units which may not provide sufficient torque for certain installations requiring a large reel. In such instances, a plurality of spring banks may be coupled through a connecting gear system to an output gear for producing the required torque. In a system of the latter construction, a separate detension coupling may be interposed within each of the individual connections of each spring bank into the gear drive. Further, in certain installations a gear coupling is not used but rather the spring drive means is coupled directly to the spool shaft assembly. For purposes of illustration one such alternative direct spring bank connection is shown in FIG. 6, which is a fragmentary view showing a coupling similar to that shown in the first embodiment.

Figure 6:
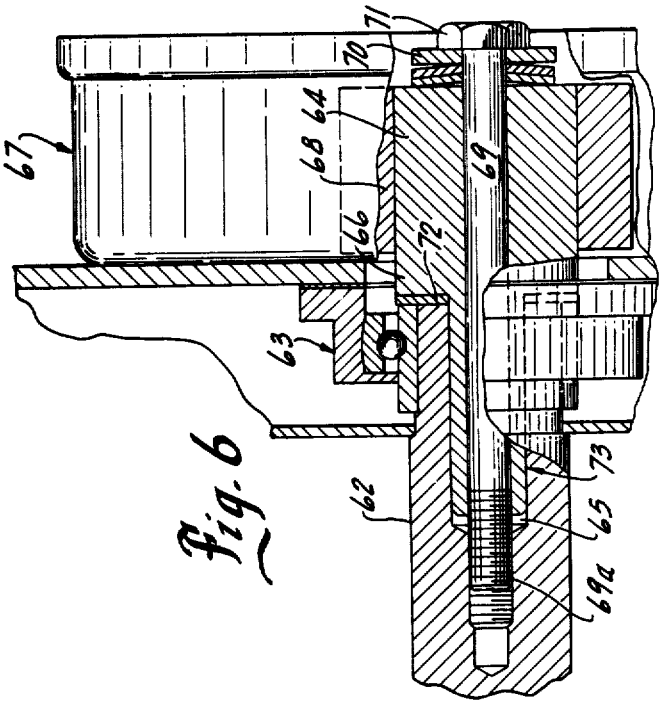
FIG. 6 is a view of an alternate embodiment of the invention.

Referring particularly to FIG. 6, spool shaft 62 is rotatably mounted in a bearing unit 63. A spring shaft 64 telescopes into an opening 65 in the shaft 62 and includes a hub 66. A friction disc 72 is shown between the hub 66 and shaft 62. A spring unit 67 is mounted on the shaft 64 and includes a hub 68 which is coupled to the shaft 64 to transmit a spool rewind force while permitting rotation of the hub on the shaft during pretensioning only such as by a standard pawl and pawl groove unit, not shown. Shaft 64 is a tubular member. A coupling bolt 69 extends through a shaft 66 and threads into a threaded opening **69*a* in the recessed end of the spool shaft 62. A "Belleville" spring and bearing washer assembly 70 is located between the hub 68 and the head 71 of bolt 69. With the bolt 69 fully drawn up, the shafts are connected and the unit rotates as an integral assembly under the cable forces and the spring forces. When the detension bolt is loosened, the coupling force through the bolt is reduced and slippage occurs between the spring shaft 64 and the spool shaft 62, as at 73**. The action is thus basically similar to that of the first embodiment in providing a rapidly positioned clutch or coupling for controlled but rapid release of the spring tension. Thus, the bolt or other similar device need only be turned a reasonably few turns to release the fixed and firm operative connection.

Although friction-type couplings provide a reliable and readily available coupling means at a reasonable cost, any other suitable quick but controlled release means may be used in the broad teaching of the present invention. For example, a releasable ratcheting or walking type of a coupling means which creates the firm interconnection for direct drive in combination with a release means to provide a controlled release of such coupling under load may be used. As any such coupling which is now available or may be specially constructed may be used, no further specific description is set forth herein. Other similar changes may of course also be made. For example, rather than parallel spring units, the reel apparatus may use series connected spring units, such as presently used in certain commercially available reel apparatus, and connected to the spool through the quick release coupling as taught herein. These and other changes may of course be made within the teaching of the present invention which is particularly directed to the spring driven reel apparatus having the controlled quick release drive coupling between the spring motor means and the spool means.

Therefore, although shown in particularly practical and preferred embodiment, the invention includes the various other forms wherein a spring driven cable reel apparatus includes any appropriate releasable coupling means between the cable support and the spring drive means which permit the controlled release of the spring tension while the cable hook-up is held in a fixed position.

The present invention thus provides a simple but reliable and rugged spring detensioning means for a cable reel apparatus.

Various modes in carrying out the invention are contemplated as being within the scope of the following claims, particularly pointing out and distinctly claiming the subject matter which is regarded as the invention.

We claim:

1. An industrial cable reel apparatus having a rotating cable support means adapted to have an elongated flexible cable wound thereon in response to rotating said cable support, comprising spring means adapted to be stressed to develop a driving force sufficient to move said cable support means under cable load, a gear coupling having an output gear means mounted on an output shaft means which is coupled to said cable support means, said output gear means including an output gear having opposite planar and parallel surfaces, said output gear being rotatably mounted on said output shaft, first and second friction drive discs disposed one each to the opposite sides of said output gear, a coupling disc abutting said first friction drive disc and connected to said output shaft to rotate therewith, resilient means located abutting said coupling disc, an input gear means mounted on an input shaft means, meshing with said output gear means and coupled to said spring means, a releasable locking means to hold said cable support means in a given position, and a releasable coupling means including a controlled release means interposed within said gear coupling and connecting at least one of said gear means to its corresponding gear shaft means, said controlled release means is attached to said output shaft and is axially movable therealong to force said coupling disc into driving engagement with said abutting friction drive disc to connect said output shaft to said output gear, said coupling means being constructed and arranged to establish an essentially operative fixed connection of the gear means to its corresponding shaft means and being selectively releasable to permit controlled release of the spring tension with said cable support means held in a given position.

2. The industrial cable reel apparatus of claim 1 wherein said releasable coupling means includes at least one "Belleville" spring washer mounted on said output shaft, and said controlled release means is a nut threaded onto said output shaft.

3. The industrial cable reel apparatus of claim 1 wherein said spring means includes a plurality of drive spring means, and said releasable coupling means includes a corresponding plurality of resilient means.

4. An industrial cable reel apparatus having a cable spool affixed to a spool shaft rotatably mounted in a support, a gear unit connected to said support and having an output shaft connected to said spool shaft and extending outwardly therefrom, said output shaft having an annular coaxial stop wall adjacent said cable spool, an output gear rotatably mounted on said output shaft, said output gear having planar end surfaces, a first friction drive disc on said output shaft between said stop wall and an adjacent inner end surface of said output gear, a second friction drive disc on said output shaft adjacent an outer end surface of said output gear, at least one Belleville washer on said output shaft abutting said second friction drive disc, a torque transmitting washer between said gear surface and said second friction drive disc, a clamping member releasably attached to said output shaft abutting said Belleville washer for collapsing said Belleville washer onto said second friction drive disc, a gear train connected to the output gear and including an input shaft rotatably mounted to said support, and at least one spiral drive spring having a spring driven shaft connected to said input shaft, and a mechanical stop connected to said support and having a lock position where it is engaged with said spool to positively hold said spool in position and prevent rotation thereof and, an unlocked position where it is positively disengaged from said spool.

5. The industrial cable reel apparatus of claim 4 including a plurality of said spiral drive springs mounted to a common shaft to provide increased drive power, and a like-plurality of said Belleville washers mounted on said output shaft.

6. The industrial cable reel apparatus of claim 4 or 5 wherein said output shaft is formed with oppositely located flats, and said torque transmitting washer is formed with a "Double-D" opening complementing said output shaft and transmitting shaft torque.

7. An industrial cable apparatus having a cable spool affixed to a spool shaft rotatably mounted in a support, a gear unit connected to said support and having a rotatable output shaft connected to said spool shaft, said output shaft having an annular coaxial stop wall adjacent to said cable spool, an output gear having planar end surfaces rotatably mounted on said output shaft, a first friction drive disc on said output shaft between said stop wall and an adjacent inner end surface of said output gear, a second friction drive disc on said output shaft adjacent an outer end surface of said output gear, first and second torque transmitting washers non-rotatably mounted on said output shaft adjacent to and outboard of said first and second friction drive discs, at least one Belleville washer on said output shaft adjacent said second torque transmitting washer, a clamping member releaseably attached to said output shaft adjacent said Belleville washer for collapsing said Belleville washer on to said torque transmitting washer, a gear train connected to the output gear and including an input shaft rotatably mounted to said support, and at least one spiral drive spring having a spring driven shaft connected to said input shaft, and a mechanical stop connected to said support and having a lock position where it is engaged with said spool to positively hold said spool in position and prevent rotation thereof and, an unlocked position where it is positively disengaged from said spool.

* * * * *